US011192613B2

(12) United States Patent
Grall

(10) Patent No.: US 11,192,613 B2
(45) Date of Patent: Dec. 7, 2021

(54) FLOATING STRUCTURE FOR THE DEPLOYMENT AND THE RECOVERY OF AT LEAST ONE AUTONOMOUS WATERCRAFT BY A VESSEL, CORRESPONDING METHOD, CORRESPONDING SYSTEM AND CORRESPONDING VESSEL

(71) Applicant: IXBLUE, Saint-Germain-en-Laye (FR)

(72) Inventor: Sébastien Grall, Aubagne (FR)

(73) Assignee: IXBLUE, Saint-Germain-en-Laye (FR)

( * ) Notice: Subject to any disclaimer, the term of this patent is extended or adjusted under 35 U.S.C. 154(b) by 0 days.

(21) Appl. No.: 16/761,760

(22) PCT Filed: Nov. 8, 2018

(86) PCT No.: PCT/FR2018/052765

§ 371 (c)(1),
(2) Date: May 5, 2020

(87) PCT Pub. No.: WO2019/092369

PCT Pub. Date: May 16, 2019

(65) Prior Publication Data

US 2020/0262520 A1 Aug. 20, 2020

(30) Foreign Application Priority Data

Nov. 8, 2017 (FR) ..... 1760492

(51) Int. Cl.
*B63B 21/56* (2006.01)

(52) U.S. Cl.
CPC ..... *B63B 21/56* (2013.01); *B63B 2211/00* (2013.01)

(58) Field of Classification Search
CPC ..... B63B 21/00; B63B 21/56; B63B 27/00; B63B 27/16; B63B 27/36; B63B 35/00; B63B 35/44; B63B 2211/00
(Continued)

(56) References Cited

U.S. PATENT DOCUMENTS 3,448,712 A * 6/1969 Adams, Jr. ..... B63C 1/02 114/259
3,631,829 A 1/1972 Kamph
(Continued)

OTHER PUBLICATIONS

International Search Report and Written Opinion, dated Mar. 14, 2019, from corresponding PCT application No. PCT/FR2018/052765.

*Primary Examiner* — Lars A Olson
(74) *Attorney, Agent, or Firm* — Nixon & Vanderhye

(57) ABSTRACT

Disclosed is a floating structure for an autonomous watercraft with a keel deployed and recovered on a vessel. The longitudinally elongate structure includes a floating portside and starboard lateral edges and a submersible bottom submerged when the structure is in the water, the lateral edges and the bottom defining an interior space at least partly submerged when the floating structure is in the water, the lateral edges defining a prow at the front and, at the rear, an opening towards the rear of the floating structure, which opening is downwardly limited by the submersible bottom with at least one longitudinally elongate slot open towards the rear for the passage of the keel, and the floating structure is configured in order that at least the front portion of the autonomous watercraft including the keel can engage by floating inside the interior space, with the keel engaging in the slot.

20 Claims, 5 Drawing Sheets

Figure 1:
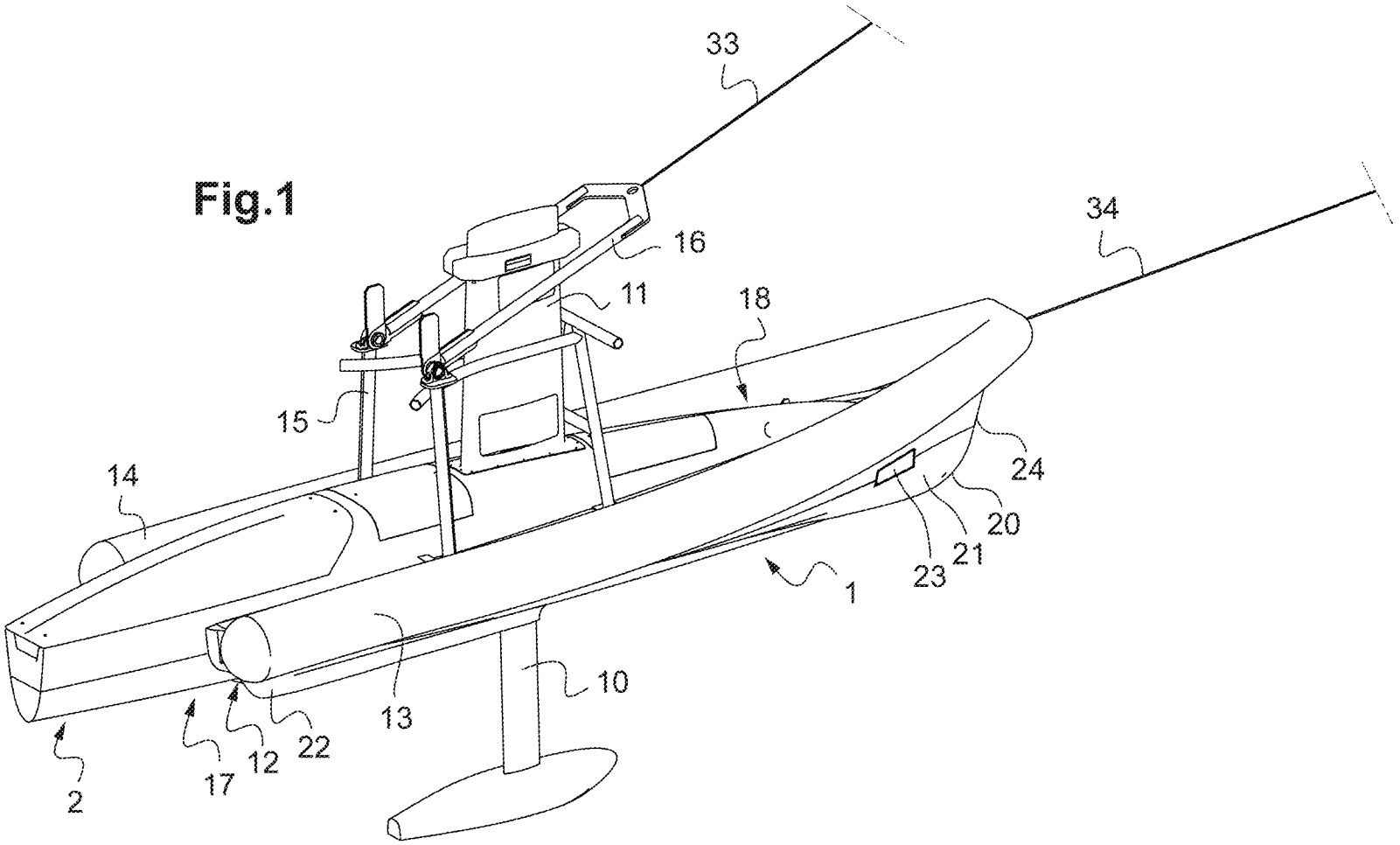

(58) Field of Classification Search
USPC ..... 114/253, 258, 259
See application file for complete search history.

(56) References Cited

U.S. PATENT DOCUMENTS

| | | | | |
|---|---|---|---|---|
| 5,222,454 | A | 6/1993 | Meyer | |
| 6,178,914 | B1 | 1/2001 | Axelsson | |
| 7,506,606 | B2 * | 3/2009 | Murphy | B63B 21/04 114/253 |
| 2006/0191457 | A1 | 8/2006 | Murphy | |
| 2012/0145064 | A1 | 6/2012 | Tureaud et al. | |

* cited by examiner

FLOATING STRUCTURE FOR THE DEPLOYMENT AND THE RECOVERY OF AT LEAST ONE AUTONOMOUS WATERCRAFT BY A VESSEL, CORRESPONDING METHOD, CORRESPONDING SYSTEM AND CORRESPONDING VESSEL

TECHNICAL FIELD TO WHICH THE INVENTION RELATES

The present invention generally relates to the field of maritime equipment, the term "maritime" being taken in the broad sense and covering equally oceans, seas, waterways, lakes or equivalents. More particularly, it relates to a floating structure for the deployment and the recovery of at least one autonomous watercraft by a vessel, and the corresponding system and vessel. A method of implementation, a system for the deployment and the recovery of at least one autonomous watercraft by a vessel, as well as an equipped vessel, complete the invention.

TECHNOLOGICAL BACK-GROUND

The deployment in the sea, more generally the launch in water, and much more the recovery of materials from a vessel on the sea is often difficult. When the matter is to launch or to recover a watercraft from a vessel, different systems can be used. Most of them consist in operating one or several "lifting points" integrated to the watercraft to be handled, then, with the use of different handling means, such as crane, gantry, lateral davits . . . , in proceeding to the lifting, then in translating the watercraft to deploy/launch it in water or, respectively, to bring it aboard the vessel for the recovery thereof.

In case of launch or recovery of an autonomous watercraft, the absence of personnel on board adds difficulty at the time of mooring or release for, respectively, the recovery or deployment thereof by the lifting means that ensures the handling.

Various remotely-operable mooring systems exist, but the difficulty is then the positioning in space of a part of such systems that is fixed with respect to the watercraft to be handled and another part of such systems that is fixed with respect to the vessel. Indeed, the movements of the vessel are not identical to those of the watercraft and, therefore, it is very difficult or even impossible, in certain sea conditions, to proceed to the mooring of the watercraft on the lifting means.

Watercraft deployment systems also exist, which use an intermediate device called a "cage", however they do not have a satisfying behaviour at sea, i.e. a sufficient capacity to float and to remain stable.

OBJECT OF THE INVENTION

The present invention proposes to use an intermediate element between the lifting means of the vessel and the autonomous watercraft to be handled. This intermediate element, which may be called "launcher", will be hereinafter referred to as "floating structure". This floating structure remains connected to the handling means of the vessel at each step of the autonomous watercraft launch or recovery operations. This floating structure may be easily brought back aboard the vessel or launched in water due to the fact that it remains connected to the handling means of the vessel. This floating structure has such a geometry that it can "sail" by being towed by the vessel. It hence has a certain floatability and a certain stability at sea avoiding it, in particular, a too easy reversal or capsizing. This floating structure has a behaviour at sea identical or at least close to that of the autonomous watercraft and is provided with an interior space for receiving the autonomous watercraft and this space is adapted to the shape of the autonomous watercraft to be recovered and stored. When the floating structure is at sea, the interior space is at least partly submerged and the autonomous watercraft, which arrives by the rear of the floating structure, may enter by its own means, by floating, the interior space of the floating structure, or conversely, exit therefrom by the rear.

Thanks to its sailing, floatability and stability characteristics, this floating structure may easily proceed to the deployment or recovery of the autonomous watercraft due to the fact that it is almost totally decoupled from the movements of the carrier vessel apart from the towing force, the latter corresponding to a practically horizontal vector, and preferably, it will be made sure that this vector is the more horizontal possible.

More particularly, it is proposed according to the invention a floating structure intended for the deployment or the recovery of at least one autonomous watercraft in aquatic environment, the autonomous watercraft having an elongated hull and comprising a keel, the autonomous watercraft being able to move in the aquatic environment at least in a surface configuration in which it floats at the surface of the aquatic environment, the floating structure being intended to be launched and to be recovered by/on a vessel.

According to the invention, the floating structure is longitudinally elongated from the rear to the front and comprises floating portside lateral edge (G) and starboard lateral edge (D) and a submersible bottom connected to the two lateral edges, the submersible bottom being immersed when the floating structure is in the water, the two floating lateral edges and the submersible bottom defining an interior space of the floating structure, the interior space being at least partly submerged when the floating structure is in the water, the two floating lateral edges joining each other on the front of the floating structure to form a bow, and the two rear ends of the floating lateral edges being separated by an opening towards the rear of the floating structure, the opening being limited downward by the submersible bottom, and the submersible bottom further comprising at least one longitudinally elongated slot open towards the rear and intended for the passage of the autonomous watercraft keel and the floating structure being configured so that at least the front part of the autonomous watercraft comprising the keel can engage by floating into the interior space, with the keel engaging into the slot.

Other non-limitative and advantageous characteristics of the structure according to the invention, taken individually or according to all the technically possible combinations, are the following:

- the submersible bottom is submerged when the floating structure is in the water,
- as an alternative, the bow is an opening on the front of the floating structure, wherein the two floating lateral edges do not join each other or only partly on the front of the floating structure,
- the autonomous watercraft has a thin front end,
- the autonomous watercraft is substantially fusiform,
- the floating structure does not sail autonomous and must be towed,
- the floating structure sails autonomously and comprises sailing means, the autonomous watercraft fully engages by floating into the interior space of the floating structure, the rear part of the autonomous watercraft comprises at least one propeller and only the rear part of the autonomous watercraft does not engage into the interior space of the floating structure, the rear part of the autonomous watercraft comprises steering means, in particular rudder and/or steerable propeller(s), the autonomous watercraft comprises no keel, the submersible bottom comprises no keel receiving slot, the autonomous watercraft comprises a keel, the autonomous watercraft comprises at least one fin and the bottom comprises one slot per fin in order to allow the passage of fins when the autonomous watercraft enters into the interior space, the fin is steerable, the autonomous watercraft has an external shape that is substantially symmetrical with respect to a median front-rear vertical plane, the floating structure is substantially symmetrical with respect to a median front-rear vertical plane, the submersible bottom comprises parts of complementary shape with respect to the adjacent shape of the autonomous watercraft hull, the submersible bottom is immersed at least at the rear part when the floating structure is in the water, the front part of the bottom remaining out of the water when the floating structure is in the water, the submersible bottom is fully immersed when the floating structure is in the water, the submersible bottom is fully immersed when the floating structure is in the water, and the floating structure comprises internally, towards the front, an out-of-water pontoon, the rear of the longitudinally elongated slot of the submersible bottom through which the keel enters when the autonomous watercraft engages into the interior space of the floating structure has a funnel or Y shape, with an introduction entry widen towards the rear, the front of the longitudinally elongated slot of the submersible bottom is closed and forms a stop for the autonomous watercraft keel in order to limit the engagement of the autonomous watercraft into the interior space of the floating structure, the longitudinally elongated slot of the submersible bottom comprises a removable position locking means allowing the slot to be closed back at the rear of the keel once the autonomous watercraft engaged in the interior space of the floating structure, the longitudinally elongated slot of the submersible bottom comprises a removable position locking means allowing the slot to be closed back at the rear of the keel once the autonomous watercraft fully engaged in the interior space of the floating structure, the edges of the longitudinally elongated slot of the submersible bottom are covered with an at least cushioning material, the structure comprises a gantry for guiding a wheelhouse of the autonomous watercraft, the guiding gantry comprises a removable position locking means allowing the wheelhouse to be held once the autonomous watercraft engaged in the interior space of the floating structure, the floating structure comprises inflatable and deflatable cushions in the interior space, said cushions, once inflated, being intended to support and/or hold and/or block the autonomous watercraft in the interior space, the inflatable and deflatable cushions are arranged on the bottom, the inflatable and deflatable cushions are arranged against the inflated bladder, the submersible bottom is configured in such a manner that the autonomous watercraft hull does not bear against the bottom when the floating structure and the autonomous watercraft are both left floating, the submersible bottom is configured in such a manner that the autonomous watercraft hull bears, directly or not, at least partly against the bottom when the floating structure and the autonomous watercraft are both left floating, the submersible bottom is configured in such a manner that the autonomous watercraft hull bears at least partly against the bottom when the floating structure and the autonomous watercraft are both left floating, said bottom comprising at its upper surface rolling means for supporting and allowing the rolling of the autonomous watercraft hull, the floating portside and starboard lateral edges are consisted of at least one elongated inflated bladder extending on each lateral side of the floating structure, from the rear to the front of said floating structure, the elongated inflated bladder is formed of several inflated pockets, sealed off from one another, the floating structure comprises a dock-based connection device complementary to a connection device of the autonomous watercraft, the complementary connection devices being intended to allow the passage of at least one fluid chosen among the electric, gaseous, liquid fluids, when they are connected to each other once the autonomous watercraft engaged in the interior space of the floating structure, the connection of the complementary connection devices is automatic when the autonomous watercraft engages into the interior space of the floating structure, the disconnection of the complementary connection devices is automatic when the autonomous watercraft exits from the interior space of the floating structure, the complementary connection devices are watertight, the floating structure further comprises, on the front, a mooring device intended to be linked to a towing line of a vessel towing said floating structure, the floating structure comprises an underwater hull shaped so as to maintain said interior space at least partly submerged when the floating structure moves forward, at least as long as a speed of displacement of the floating structure is lower than a limit speed of 3 meters per second, the underwater hull of the floating structure comprises, in front part, at least one water intake in communication with said interior space and the aquatic environment of the floating structure, the underwater hull of the floating structure comprises an optional fin, directed so that the water flow exerts on the fin a force directed downward when the floating structure moves forward, the underwater hull of the floating structure is shaped in such a manner to keep stable floating structure heading angle and heel angle when the floating structure moves forward, at least as long as the moving speed of the floating structure is lower of said limit speed.

The invention also relates to a method for the recovery of at least one autonomous watercraft in aquatic environment, the autonomous watercraft having an elongated hull and comprising a keel, the autonomous watercraft being able to move in the aquatic environment at least in a surface configuration in which it floats at the surface of the aquatic environment, in which method, a floating structure with a submersible bottom and a rear opening according to the present patent application is placed on the water, said floating structure being linked to at least one cable, it is made sure that the autonomous watercraft in the surface configuration approaches the floating structure by the rear opening and enters the interior space of the floating structure, then the floating structure, with the autonomous watercraft in its interior space, is pulled by said at least one cable to be extracted from water, in particular on a vessel.

In variants of the method, potentially combined with other variants described:

said at least one cable is a towing cable, said at least one cable is a operating cable.

The invention also relates to a system comprising at least one autonomous watercraft and the floating structure with a submersible bottom and a rear opening according to the present patent application, the floating structure, once in water, being able to receive said at least one autonomous watercraft in an interior space, through the rear opening.

The invention also relates to a vessel intended for the deployment and the recovery of at least one autonomous watercraft and that comprises, on the one hand, the floating structure with a submersible bottom and a rear opening according to the present patent application, the floating structure, once in water, being able to receive said at least one autonomous watercraft in an interior space, through the rear opening, and, in the other hand, means for the launching of the floating structure and the recovery thereof on board the vessel. The vessel may furthermore take different forms according to all the possibilities described.

DETAILED DESCRIPTION OF AN EXEMPLARY EMBODIMENT

The following description in relation with the appended drawings, given by way of non-limitative examples, will allow a good understanding of what the invention consists of and of how it can be implemented.

Figure 2:
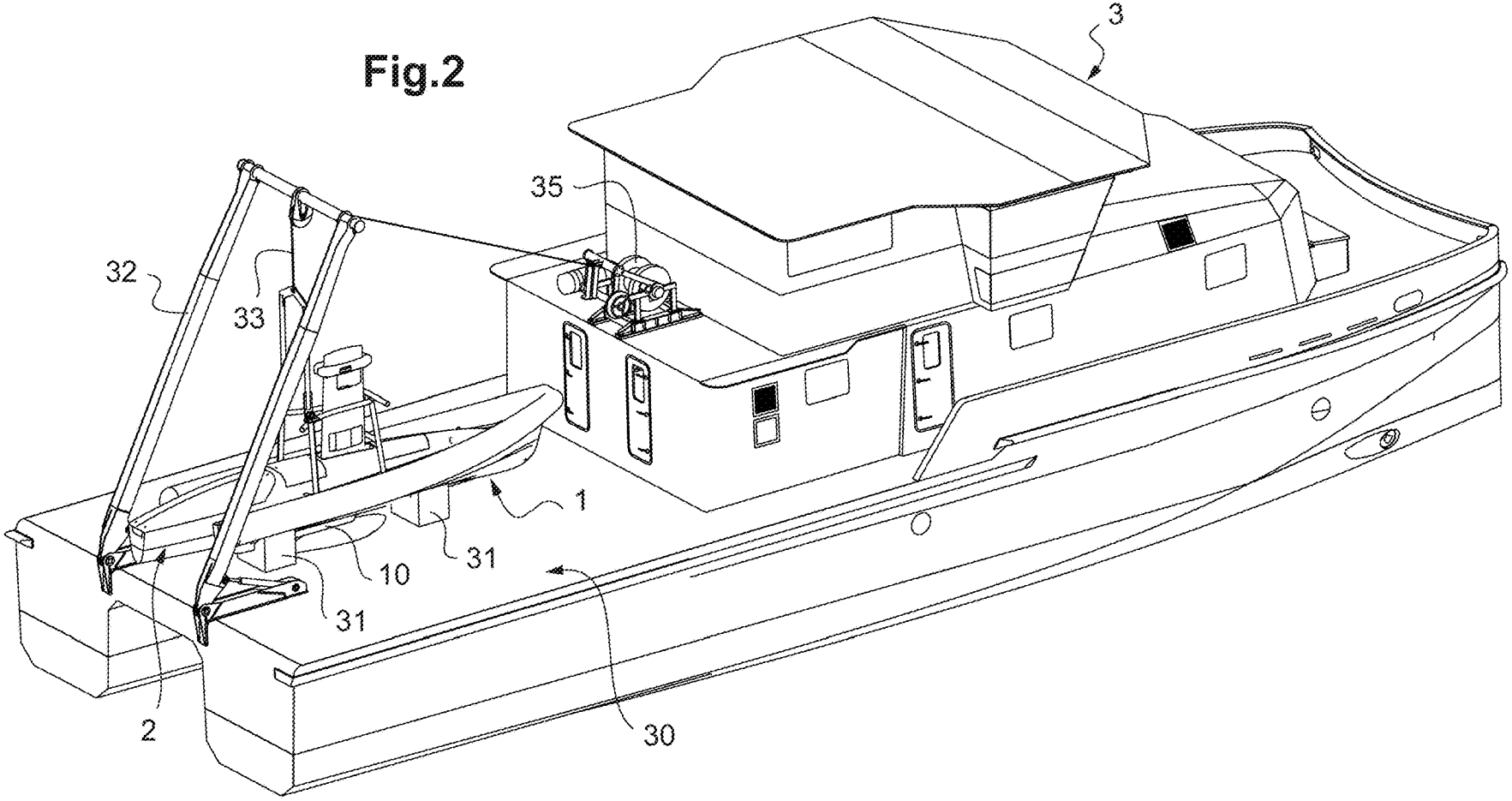
Figure 3:
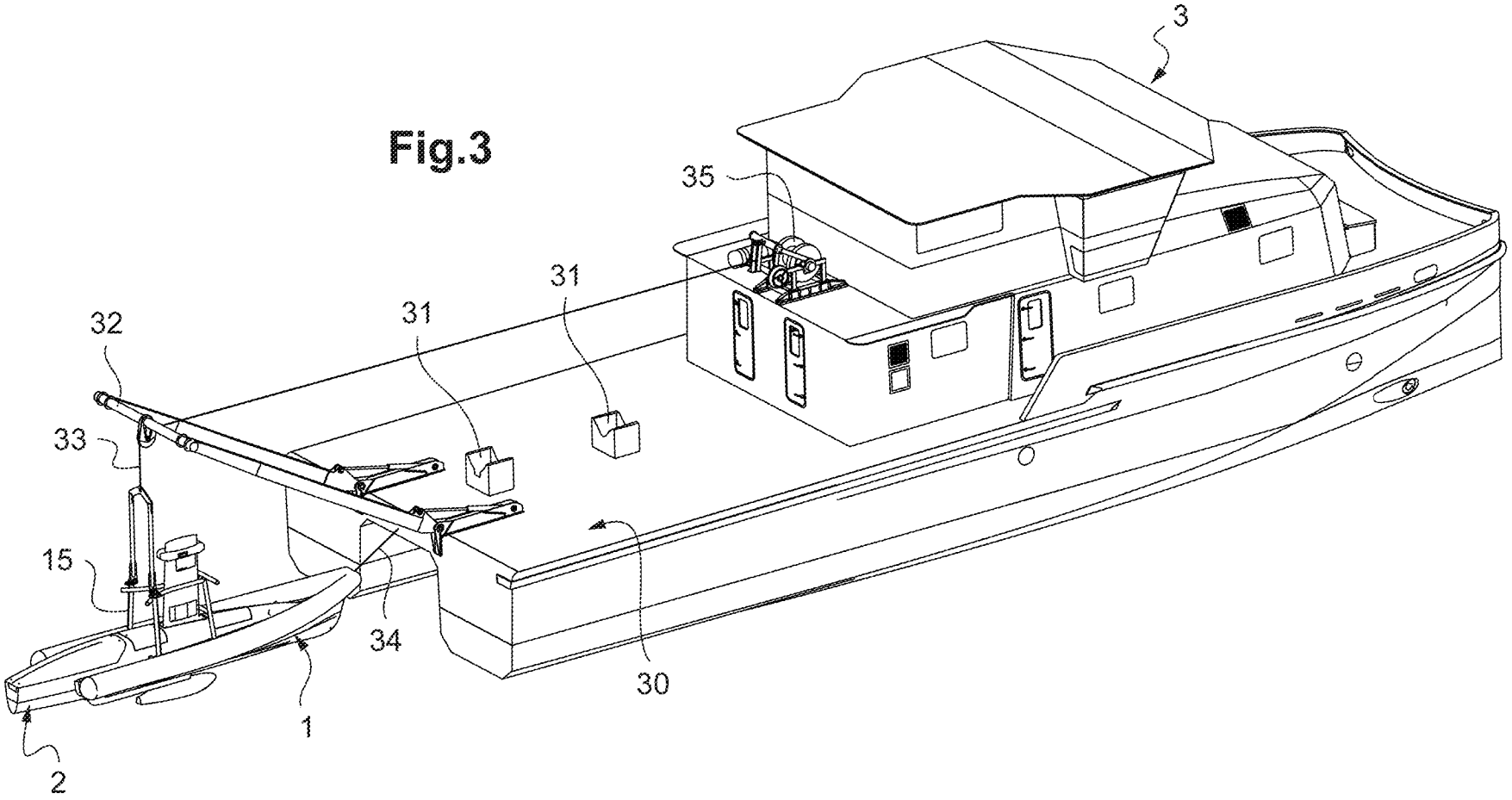
Figure 4:
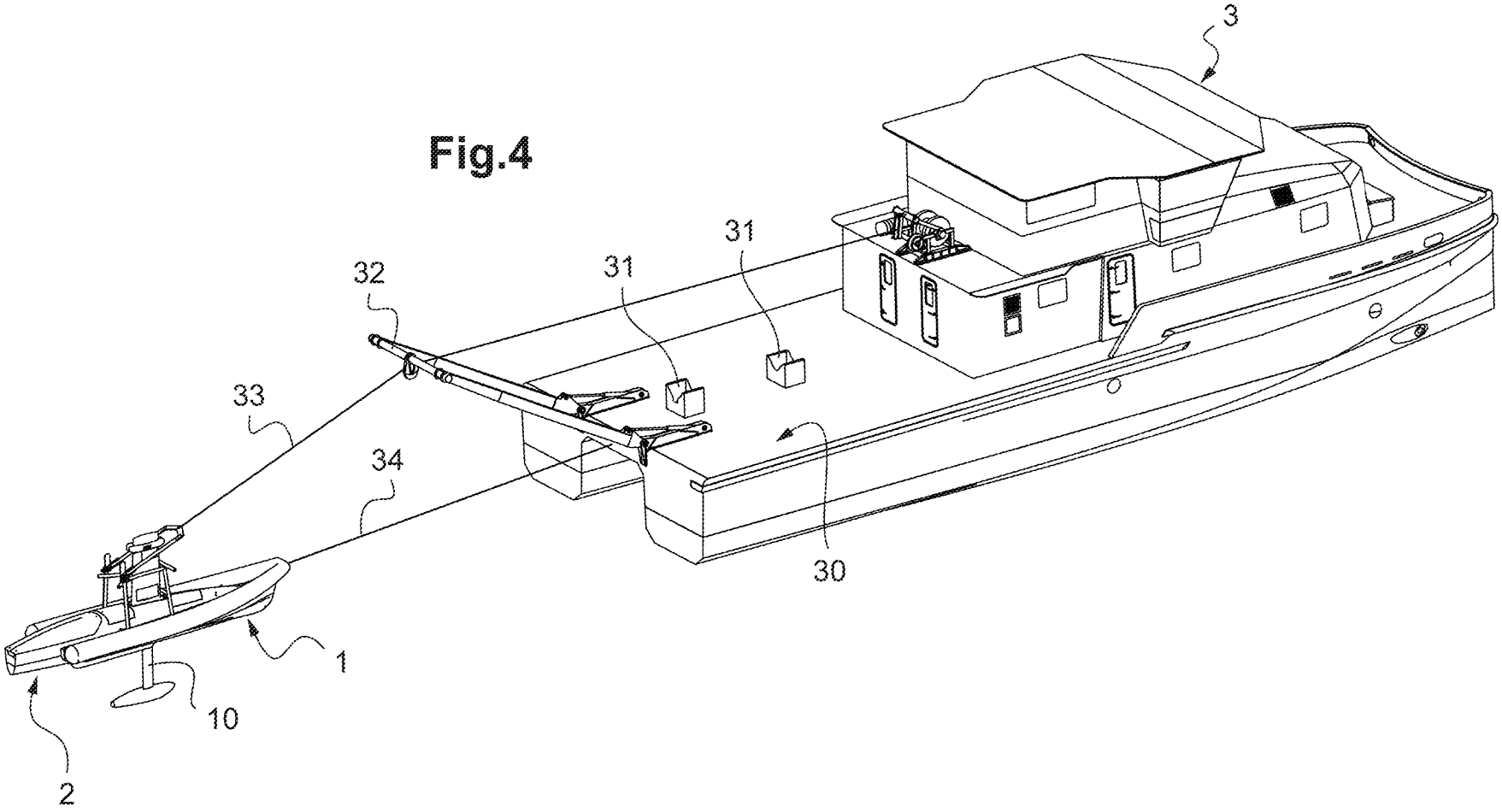
Figure 5:
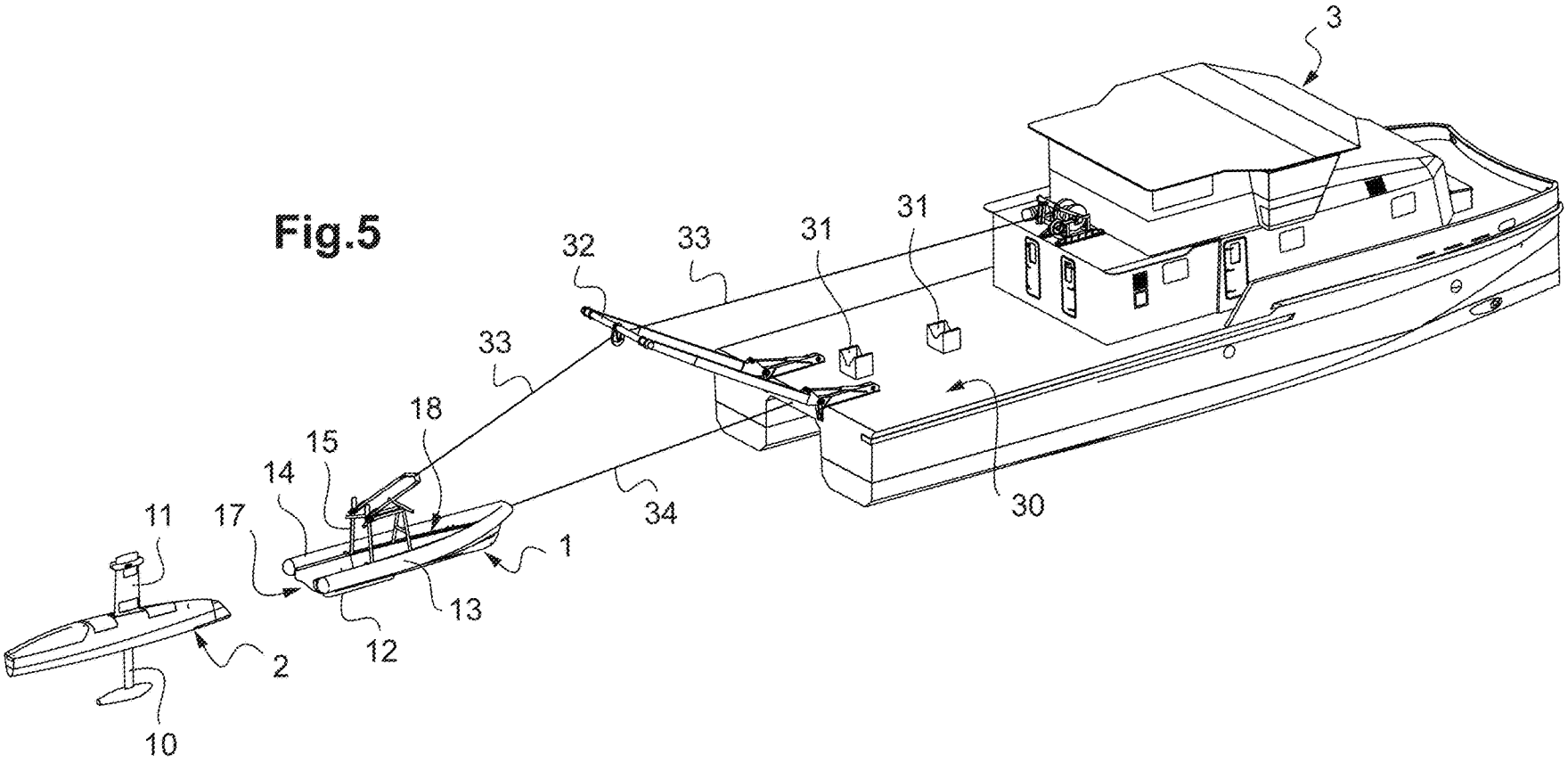

In the appended drawings:

FIG. 1 shows a towed floating structure, which has received an autonomous watercraft, FIGS. 2 to 5 show a system for the deployment and the recovery, from a vessel, of an autonomous watercraft, using a floating structure, and showing the different steps of the deployment (or, conversely, from FIGS. 5 to 2, the recovery steps).

In FIG. 1, a floating structure 1 is shown, which is towed on the sea (not shown) by being pulled at the bow thereof by a towing cable 34. The floating structure comprises a hull consisted of a submersible bottom 12 and an inflated bladder forming two lateral edges, a portside lateral edge (G) 14 and starboard lateral edge (D) 13. The lateral edges 13, 14 ensure the floatability of the floating structure 1. The submersible bottom 12 is for its part immersed, in particular due to the presence of an opening 17 on the rear of the floating structure 1, between the rear ends of the inflated bladder forming the two lateral edges 13, 14. An interior space of the floating structure 1 is hence defined, which is delimited by the inflated bladder and the submersible bottom, and into which an autonomous watercraft can be received.

The inflated bladder may be consisted of several inflated pockets, sealed off from one another, in the style of semi-rigid boats of the market. The inflated bladder increases the stability of the floating structure 1 while playing a role of cushioning and protection with respect to the shocks liable to occur between the floating structure and the vessel or the autonomous watercraft 2. It may be provided that, at the delivery of the floating structure 1, or when it is not used and does not store the autonomous watercraft 2, it may be dismounted and deflated to be stored in a small volume state.

In variant embodiments, the lateral edges may be other than an inflated bladder and, for example, hulls or hull parts, notably rigid, ensuring the floatability of the floating structure. Inflated parts may also be associated with hull parts.

In any event, the underwater hull of the floating structure 1, i.e. the part of this structure that is immersed, has a shape that provides the floating structure with a good sailing ability. This shape allows in particular the floating structure 1 to keep stable heading angle and heel angle (i.e. roll angle) when it moves forward under the action of the towing cable 34, and that at least up to a limit speed of 3 meters per second, or even up to a speed of 5 meters per second. Herein, thanks to the shape of this underwater hull, by calm sea (i.e. for a swell of amplitude lower than 0.5 meter), the average fluctuations of the heading angle and those of the heel angle each remain lower than 20 degrees, when the floating structure 1 moves forward at a speed lower than or equal to said limit speed. The sailing ability of the floating structure 1 is also observed when the swell amplitude is higher or when the wind strengthens.

In the particular example shown in the figures, to obtain this sailing ability, the underwater hull of the floating structure 1 comprises a stem 24 that extends substantially vertically, from the floating line of the floating structure down to the depth of the submersible bottom 12, thus forming a marked cutwater joining a portside part and a starboard part 21 of the hull. At the lower end of the stem, the portside and starboard parts of the hull are concave, viewed from the water, so that they join each other and form a great ridge 20 that facilitates the penetration into water and helps maintaining the heading of the floating structure 1. Moreover, each lateral edge 13, 14 is provided, on the rear, with an optional fin 22, which extends substantially parallel to the longitudinal front-rear axis of the floating structure 1, and that plays in a certain manner the role of a centreboard, or a fixed rudder.

It is to be noted that the term "underwater hull" herein denotes the part of the floating structure 1 that is immersed, i.e. located under the floating line, when the floating structure 1 is in the water and stationary with respect to the water (the autonomous watercraft 2 being then not housed in the above-mentioned interior space 18). In the example of FIG. 1, the underwater hull hence corresponds to the immersed part of the hull of the floating structure 1.

The sailing ability of the floating structure 1 allows it to release or recover the autonomous watercraft 2 whereas the floating structure 1 and the autonomous watercraft 2 move at the surface of water. This is interesting in particular because the autonomous watercraft 2 is more easily operable when it moves, so that it is hence more easy to recover the autonomous watercraft 2 when the floating structure 1 and the watercraft both move, at moderated speed, at the surface of water.

Moreover, the underwater hull of the floating structure 1 is shaped so as to maintain said interior space 18 at least partly submerged, when the floating structure 1 moves forward, at least as long as a moving speed of the floating structure is lower than the limit speed mentioned hereinabove.

This specific shape of the underwater hull is important to allow a recovery in move of the autonomous watercraft 2 (as explained hereinabove). Indeed, in the absence of particular precaution, a move forward of the floating structure 1, under the action of the towing cable 34, would lead the floating structure 1 to squat and the inner volume 18 intended to receive the autonomous watercraft 1 to exit from water (this squat being particularly marked due to the extent of the bottom 12 of the floating structure).

In the example shown in the figures, in order to avoid that the inner volume 18 exits from water, the underwater hull is more precisely shaped so as to allow water to enter by the front of this inner volume, when the floating structure 1 moves forward. The underwater hull hence comprises, in the front part (i.e. closer to the bow than to the stern), two water intakes 23, portside and starboard, putting said interior space 18 in communication with the aquatic environment of the floating structure 1 (in FIG. 1, only the starboard water intake 23 is visible). These water intakes 23 are made in the form of openings made in the hull of the floating structure 1, located at least partly under the floating line of this structure.

As a variant or as a complement, the underwater hull could comprise one or several optional fins (not shown), each directed so that the water flow exerts on the fin a force directed downward when the floating structure 1 moves forward.

A floating autonomous watercraft 2 simply entered into the floating structure 1 on the bottom 12 by a simple relative movement between both of them, due to the fact that the rear of the floating structure 1 is open and that the submersible bottom 12 is immersed. Preferably, a sufficient draft is provided between the low part of the hull of the floating structure 1 and the bottom 12 (except the keel that must pass through a median longitudinal slot/opening of the bottom) to avoid that the autonomous watercraft 2 rubs on the bottom during this relative movement. Although the behaviours at sea of the floating structure 1 and of the autonomous watercraft 2 are neighbours, there may be slightly different pitches, rolls and/or inclinations between both and these latter may be taken into account to define the height of this draft. It may be noted that, on the rear and laterally, the presence of the bladder constitutes a security in that, in case of shock at these levels between the floating structure 1 and the autonomous watercraft 2, a certain cushioning is obtained.

When the floating structure 1 with the autonomous watercraft 2 inside will be lifted out of the water, the autonomous watercraft 2 will come and bear on the bottom 12 of the floating structure 1 due to the disappearance of the water that made it float above the bottom when the floating structure 1 was at sea. The bottom 12 and, more generally, the floating structure 1 are not configured to store water when the floating structure 1 is brought back on the vessel.

The autonomous watercraft 2 is herein only floating but, in other applications, it may be mixed, i.e. it may have a floating state and a submersed state, the floating state being necessary to enter into or exit from the floating structure 1, except providing a sufficiently deep bottom 12 so that the autonomous watercraft 2 can be received, whereas the latter is in submersion, in practice shallow submersion. The submersible bottom 12 is substantially rigid. In a variant, a flexible submersible bottom is provided, which forms an open pocket on the rear and which may be enlarged to increase its height or reduced at will to receive the autonomous watercraft 2 as a fish in a fishing net.

The autonomous watercraft 2 comprises a substantially fusiform hull with, downward, a submersed keel 12, and upward, an out-of-water wheelhouse 11. This autonomous watercraft 2 comprises integrated propelling means allowing it to enter into and exit from the floating structure 1 and to move in or on the sea, according to the cases, autonomously, with preprogrammed and/or remote-controlled movements.

The floating structure 1 is intended to be brought back on a vessel or launched from a vessel. In order to facilitate these operations, a gantry 15 has been installed on the floating structure 1, gantry with has an articulated arm 16 connected to an operating cable 33 in order to be able to lift the floating structure 1, with possibly the autonomous watercraft 2 inside, using the operating cable 33. Preferably, the gantry and, in particular the articulated arm 16, are arranged in an equilibrium area making so that, when the floating structure 1 with the autonomous watercraft 2 inside are lifted out of water, they remain substantially horizontal. Failing that, the towing cable may help in maintaining the floating structure 1 horizontal. In addition or as an alternative, it may however be provided on the vessel means of the inclined plane or rolling plane type to guide and direct the floating structure 1, with possibly the autonomous watercraft 2 inside, so as to avoid an untimely tilting during the recovery and launching operations.

It is to be noted that the presence of the wheelhouse 11 is advantageously used to provide a stabilizing guide in the gantry 15. This stabilizing guide for the wheelhouse also forms herein a stop for the front of the wheelhouse 11. This stabilizing guide for the wheelhouse comes in complement to the medial longitudinal slot (not visible) made through the bottom 12 and that allows the passage of the keel 10 and that also forms a guide and potentially a stop for the front of the keel 10. Means (not shown) for locking the position of the autonomous watercraft 2 in the floating structure 1 are provided. These position locking means are removable, and they are closed for the recovery on board the vessel of the floating structure 1 with the autonomous watercraft 2 inside, and open when the autonomous watercraft 2 is to be launched in the sea whereas the floating structure has been launched in water. These removable position locking means act normally on the keel (in the slot) and/or the wheelhouse (on the gantry 15).

The floating structure is hence equipped with guides allowing the autonomous watercraft 2 to easily enter the interior space 18 and some of these guides may also be consisted of inflatable and deflatable cushions so that the latter could serve, when inflated, to block the autonomous watercraft 2 when the latter is in position in the interior space 18.

Preferably, automatic and watertight connections means are provided between the floating structure 1 and the autonomous watercraft 2, allowing the connection when the autonomous watercraft 2 is installed in the floating structure 1. The towing cable 34 may comprise pipes, in particular for pressurized gas, fuel, etc., and/or electrical conductors, in particular for power supply and/or data transfer.

Hence, the floating structure 1 may be equipped with automatic connectors allowing an electric connection between the watercraft 2 and the carrier vessel when the watercraft is positioned in the interior space 18 of the floating structure 1. The floating structure 1 may also be equipped with automatic connectors allowing a data connection between the watercraft 2 and the floating structure 1 and/or the vessel 3 when the watercraft 2 is positioned in the interior space 18 of the floating structure 1. The floating structure 1 may also be equipped with automatic connectors allowing a fuel connection between the watercraft 2 and the floating structure 1 and/or the vessel 3 when the watercraft 2 is positioned in the interior space 18 of the floating structure 1, so that the watercraft can be refueled. It may be the same for other fluids, such as, for example, pressurized gas.

Until now, a floating structure 1 capable of receiving only one autonomous watercraft 2 has been described. It is however possible to make a floating structure 1 capable of receiving two, or even three autonomous watercrafts 2. For each autonomous watercraft 2, a longitudinal slot is provided through the bottom 12 and possibly a stabilizing guide for each wheelhouse 11. In this case, the autonomous watercrafts 2 are stored parallel to each other, as above longitudinally, in the floating structure 1. In the case of two autonomous watercrafts 2, preferably, the inflated bladder is configured to form a median separator extending up to the rear of the floating structure 1, just as the lateral edges 13, 14, the inflated bladder having then a W-like shape. This principle may be extended to three autonomous watercrafts 2 or more, and in this case, the inflated bladder has then a comb shape.

We will now describe, in relation with FIGS. 2 to 5, the operations of deployment and, by symmetry, recovery, of an autonomous watercraft by a vessel, thanks to the implementation of the floating structure 1 of the invention.

In FIG. 2, a vessel 3 transports on its rear deck 30 a floating structure 1 in which an autonomous watercraft 2 is installed. The floating structure 1 is placed in height on separated supports 31 so that the keel 10 finds its place on the rear deck 30. In an embodiment, the keel 10 may be moved up and down according to the needs, as in the present case. The floating structure 1 and the autonomous watercraft 2 thereof are fastened to the rear deck 30 by removable fastening means. A handling gantry 32, which is arranged on the rear of the rear deck 30, comprises a pulley on which the operating cable 33 is wound. The operating cable 33 may be wound and unwound using a handling winch 35.

In FIG. 3, the floating structure 1 and the autonomous watercraft 2 thereof have been launched in water. The removable fastening means had been open in order to release the floating structure 1. The operating cable 33 and the handling gantry 32 have been operated, which has allows lifting the floating structure 1 and the autonomous watercraft 2 thereof, then translating them towards the rear of the vessel 3 by tilting of the handling gantry 32, above the water on which they have been moved down. It can be noted that the towing cable 34 connects the floating structure 1 to the vessel 3.

In FIG. 4, the floating structure 1 and the autonomous watercraft 2 thereof, which are in water, move away from the vessel while continuing to be towed. For that purpose, the operating cable 33 and the towing cable 34 are progressively unwound. It is to be noted that the keel 10 has been moved down.

In FIG. 5, the means for locking the position of the autonomous watercraft 2 in the floating structure 1 have been unlocked and the floating structure 1 and the autonomous watercraft 2 have been separated from each other, the floating structure 1 continuing to be towed. The autonomous watercraft 2, which floated in the interior space of the floating structure 1, has hence been made free to leave the floating structure through the opening 17 on the rear of the latter. The autonomous watercraft 2 can now freely go about its business. It may possibly be provided to bring back the empty floating structure 1 into the vessel if desired.

For the recovery of the autonomous watercraft 2 on board the vessel 3, the previous operations will be performed in the reverse order but with a (re)locking of the autonomous watercraft 2 in position in the floating structure 1, then a (re)fastening of the floating structure 1 on the rear deck of the vessel 3.

It is understood that the invention can be made in many other ways, without thereby departing from the framework defined by the description and the claims. For example, as an alternative embodiment, the two floating portside and starboard lateral edges do not join each other on the front of the floating structure and the bow then corresponds to an opening on the front of the floating structure, the two lateral edges joining each other and being fastened to each other by a transverse coupling and the floating structure is then similar to a catamaran. In this catamaran, a part of the coupling between the two lateral edges is submersible and corresponds to the bottom. The two lateral edges may be two inflated bladders or two hulls. The underwater hull of this catamaran-type floating structure then comprises the bottom in question, and two parts of the two lateral edges, which are immersed when the floating structure is in water, is stationary. As hereinabove, this underwater hull comprises, on the front part, a water intake thanks to which the interior space 18 remains submersed, at least in part, when the floating structure moves forward. This water intake herein corresponds to the front opening, mentioned hereinabove, defined between the portside and the starboard lateral edges.

For example, the floating structure 1 may be provided with abilities allowing it to sail on its own by taking onboard and under the direction of a personnel. In this last configuration, it is provided with a propulsion and a man-machine interface.

The implementation with a vessel has been mentioned, but the floating structure can also be used for the handling of autonomous watercrafts from the dry land or from a helicopter or any other suitable device.

Finally, the floating structure can be used as a floating dock for receiving or storing in a port at least one autonomous watercraft.

The invention claimed is:

1. A floating structure (1) intended for the deployment or the recovery of at least one autonomous watercraft (2) in aquatic environment, the autonomous watercraft (2) having an elongated hull and comprising a keel (10), the autonomous watercraft (2) being able to move in the aquatic environment at least in a surface configuration in which it floats at the surface of the aquatic environment, the floating structure (1) being intended to be launched and to be recovered by/on a vessel (3), wherein the floating structure (1) is longitudinally elongated from the rear to the front and comprises a floating portside lateral edge (14) and a starboard lateral edge (13) and a submersible bottom (12) connected to the two floating portside and starboard lateral edges, the submersible bottom (12) being immersed when the floating structure (1) is in the water, the two floating portside and starboard lateral edges (14, 13) and the submersible bottom (12) defining an interior space (18) of the floating structure (1), the interior space (18) being at least partly submerged when the floating structure (1) is in the water, the two floating portside and starboard lateral edges (14, 13) joining each other on the front of the floating structure (1) to form a bow, and the two rear ends of the floating portside and starboard lateral edges (14, 13) being separated by an opening (17) towards the rear of the floating structure (1), the opening (17) being limited downward by the submersible bottom (12), and the submersible bottom (12) further comprises at least one longitudinally elongated slot open towards the rear and intended for the passage of the keel (10) of the autonomous watercraft (2) and the floating structure (1) is configured so that at least the front part of the autonomous watercraft (2) comprising the keel (10) can engage by floating into the interior space, with the keel (10) engaging into the slot, wherein the floating portside and starboard lateral edges (14, 13) comprise at least one elongated inflated bladder extending on each lateral side of the floating structure (1), from the rear to the front of said floating structure, and the floating structure further including an underwater hull shaped so as to maintain said interior space (18) at least partly submerged when the floating structure (1) moves forward, at least as long as a speed of displacement of the floating structure is lower than a limit speed of 3 meters per second, the underwater hull of the floating structure (1) comprising, in a front part of the underwater hull, at least one water intake (23) in communication with said interior space (18) and the aquatic environment of the floating structure (1).

2. The floating structure (1) according to claim 1, wherein the front of the longitudinally elongated slot of the submersible bottom (12) is closed and forms a stop for the keel (10) of the autonomous watercraft (2) in order to limit the engagement of the autonomous watercraft (2) into the interior space of the floating structure (1).

3. The floating structure (1) according to claim 1, wherein the longitudinally elongated slot of the submersible bottom (12) comprises a removable position locking device allowing the slot to be closed back at the rear of the keel (10) once the autonomous watercraft (2) engaged in the interior space of the floating structure (1).

4. The floating structure (1) according to claim 1, further comprising inflatable and deflatable cushions in the interior space, said cushions, once inflated, being intended to support and/or hold and/or block the autonomous watercraft (2) in the interior space.

5. The floating structure (1) according to claim 1, further comprising a dock-based connection device complementary to a connection device of the autonomous watercraft (2), the complementary connection devices being intended to allow the passage of at least one fluid chosen among the electric, gaseous, liquid fluids, when they are connected to each other once the autonomous watercraft (2) engaged in the interior space of the floating structure (1).

6. The floating structure (1) according to claim 1, further comprising, on the front, a mooring device intended to be linked to a towing line (34) of a vessel (3) towing said floating structure (1).

7. The floating structure (1) according to claim 1, further comprising a gantry for guiding a wheelhouse of the autonomous watercraft.

8. The floating structure (1) according to claim 1, wherein the underwater hull of the floating structure (1) comprises at least one fin directed so that the water flow exerts on the fin a force directed downward when the floating structure (1) moves forward.

9. The floating structure (1) according to claim 1, wherein the underwater hull of the floating structure (1) is shaped in such a manner to keep stable floating structure heading angle and heel angle when the floating structure (1) moves forward, at least as long as the moving speed of the floating structure is lower of said limit speed.

10. A method for the recovery of at least one autonomous watercraft (2) in aquatic environment, the autonomous watercraft (2) having an elongated hull and comprising a keel (10), the autonomous watercraft (2) being able to move in the aquatic environment at least in a surface configuration in which it floats at the surface of the aquatic environment, wherein a floating structure (1) with a submersible bottom (12) and a rear opening (17) according to claim 1 is placed on the water, said floating structure (1) being linked to at least one cable (33, 34), it is made sure that the autonomous watercraft (2) in the surface configuration boards the floating structure (1) by the rear opening (17) and enters the interior space (18) of the floating structure (1), then the floating structure (1), with the autonomous watercraft (2) in its interior space, is pulled by said at least one cable (33, 34) to be extracted from water, on a vessel (3).

11. A system comprising at least one autonomous watercraft (2) and the floating structure (1) with a submersible bottom (12) and a rear opening (17) according to claim 1, the floating structure (1), once in water, being able to receive said at least one autonomous watercraft (2) in an interior space, through the rear opening (18).

12. The vessel (3) intended for the deployment and the recovery of at least one autonomous watercraft (2) and that comprises the floating structure (1) with a submersible bottom (12) and a rear opening (17) according to claim 1, the floating structure (1), once in water, being able to receive said at least one autonomous watercraft (2) in an interior space (18), through the rear opening, and means for the launching of the floating structure (1) and the recovery thereof on board the vessel (3).

13. The floating structure (1) according to claim 2, wherein the longitudinally elongated slot of the submersible bottom (12) comprises a removable position locking device allowing the slot to be closed back at the rear of the keel (10) once the autonomous watercraft (2) engaged in the interior space of the floating structure (1).

14. The floating structure (1) according to claim 3, further comprising a dock-based connection device complementary to a connection device of the autonomous watercraft (2), the complementary connection devices being intended to allow the passage of at least one fluid chosen among the electric, gaseous, liquid fluids, when they are connected to each other once the autonomous watercraft (2) engaged in the interior space of the floating structure (1).

15. The floating structure (1) according to claim 3, further comprising a gantry for guiding a wheelhouse of the autonomous watercraft.

16. The floating structure (1) according to claim 4, wherein the longitudinally elongated slot of the submersible bottom (12) comprises a removable position locking device allowing the slot to be closed back at the rear of the keel (10) once the autonomous watercraft (2) engaged in the interior space of the floating structure (1).

17. The floating structure (1) according to claim 2, further comprising a dock-based connection device complementary to a connection device of the autonomous watercraft (2), the complementary connection devices being intended to allow the passage of at least one fluid chosen among the electric, gaseous, liquid fluids, when they are connected to each other once the autonomous watercraft (2) engaged in the interior space of the floating structure (1).

18. The floating structure (1) according to claim 2, further comprising a gantry for guiding a wheelhouse of the autonomous watercraft.

19. The floating structure (1) according to claim 2, wherein the underwater hull of the floating structure (1) comprises at least one fin directed so that the water flow exerts on the fin a force directed downward when the floating structure (1) moves forward.

20. The floating structure (1) according to claim 3, wherein the underwater hull of the floating structure (1) comprises at least one fin directed so that the water flow exerts on the fin a force directed downward when the floating structure (1) moves forward.

* * * * *